US008720483B2

(12) United States Patent
Thorwesten

(10) Patent No.: US 8,720,483 B2
(45) Date of Patent: May 13, 2014

(54) DEVICE FOR EQUALIZING PRESSURE SURGES IN CLOSED SYSTEMS, SUCH AS SILOS OR THE LIKE

(75) Inventor: Albert Thorwesten, Beckum (DE)

(73) Assignee: Thorwesten Vent GmbH, Beckum (DE)

( * ) Notice: Subject to any disclaimer, the term of this patent is extended or adjusted under 35 U.S.C. 154(b) by 1305 days.

(21) Appl. No.: 12/312,618

(22) PCT Filed: Nov. 27, 2007

(86) PCT No.: PCT/EP2007/010265
§ 371 (c)(1),
(2), (4) Date: May 19, 2009

(87) PCT Pub. No.: WO2008/064853
PCT Pub. Date: Jun. 5, 2008

(65) Prior Publication Data

US 2010/0044374 A1 Feb. 25, 2010

(30) Foreign Application Priority Data

Dec. 1, 2006 (DE) ..... 20 2006 018 244 U

(51) Int. Cl.
*F16K 15/03* (2006.01)

(52) U.S. Cl.
USPC ..... 137/527.6; 137/316; 220/88.2

(58) Field of Classification Search
USPC ..... 137/527, 316, 315.01; 285/406; 220/203.09, 88.2; 169/48; 222/189.01
See application file for complete search history.

(56) References Cited

U.S. PATENT DOCUMENTS

| | | | | | |
|---|---|---|---|---|---|
| 1,755,624 | A | * | 4/1930 | Yount | 220/89.4 |
| 1,974,091 | A | * | 9/1934 | Wortmann | 220/88.2 |
| 3,211,283 | A | * | 10/1965 | Hassler | 206/424 |
| 3,330,080 | A | * | 7/1967 | Grieb et al. | 52/86 |
| 3,465,967 | A | * | 9/1969 | Card | 239/265.23 |
| 3,590,858 | A | | 7/1971 | Martin | |

(Continued)

FOREIGN PATENT DOCUMENTS

| | | |
|---|---|---|
| FR | 1 198 120 | 12/1959 |
| WO | WO 90/11816 | 10/1990 |
| WO | WO 95/10465 | 4/1995 |

OTHER PUBLICATIONS

International Search Report, May 3, 2008.

*Primary Examiner* — Kevin Lee
*Assistant Examiner* — Macade Brown
(74) *Attorney, Agent, or Firm* — Collard & Roe, P.C.

(57) ABSTRACT

With a device (1) for equalizing pressure surges in cases of possible dust or gas explosions in closed systems, such as silos, pipelines or the like, comprising a hinged cover (3) which can be pivoted on an outlet connection or a closing edge (2) and has a smooth outer surface (12) and comprising a deflecting plate (8) on the outlet connection or on the closing edge (2) for the cover (3) to strike against in the event of an explosion, it is intended to achieve not only cost-effective production but also in particular a significant weight saving of the hinged cover, quick changing of the cover in the case of damage, or quick fitting of the cover in the first instance, and an improvement in the protective effect of the system. This is achieved by the hinged cover (3) being made of a carbon/glass-fiber material, whereby the main lid body (3*a*) is formed from carbon/glass fiber mats (18, 19) that form the outer walls (12, 13), with an enclosed body (14) made of plastic, such as foam material, for example, forming the lid contour.

11 Claims, 6 Drawing Sheets

(56) References Cited

U.S. PATENT DOCUMENTS

Figure 1:
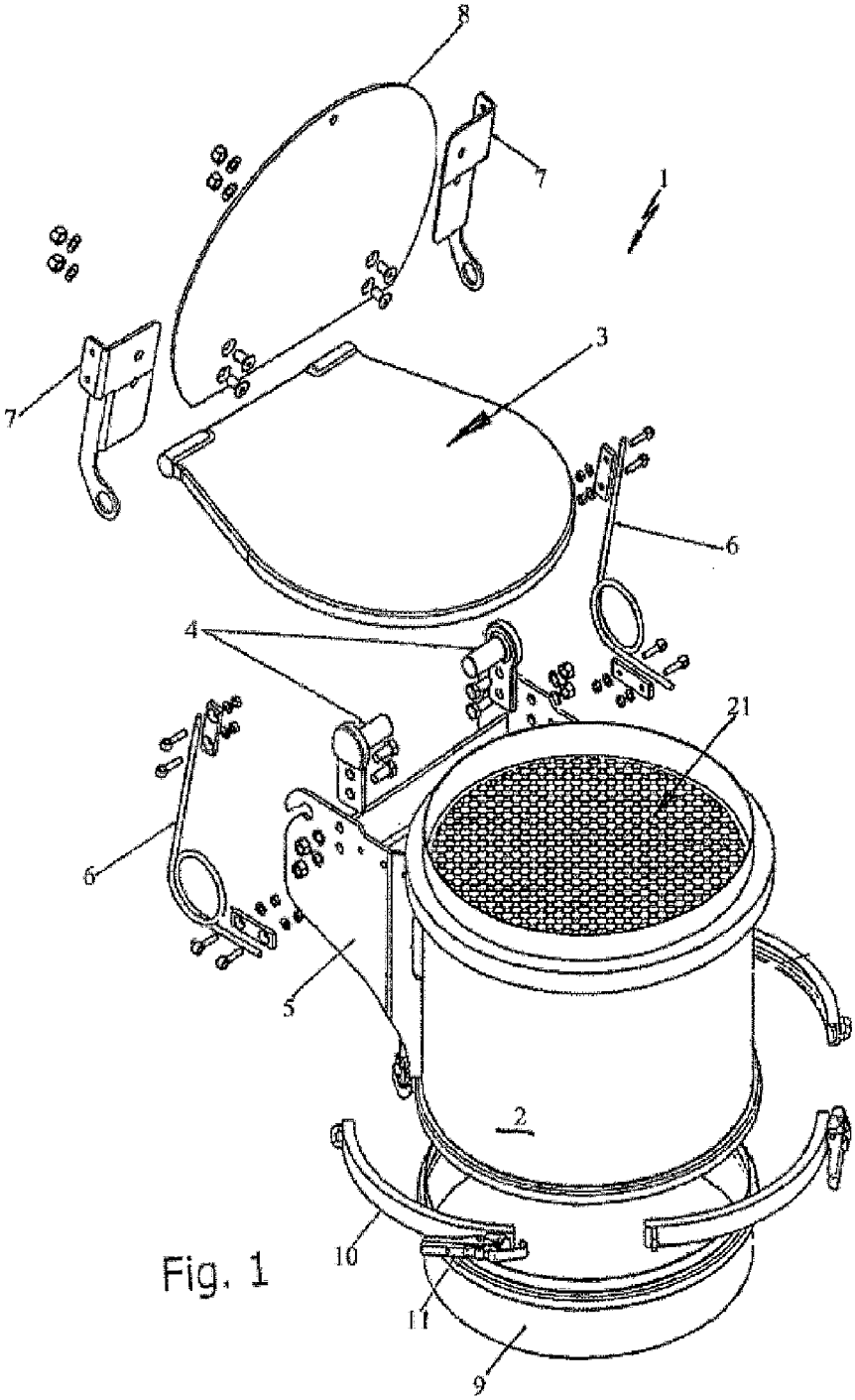

| | | | | |
|---|---|---|---|---|
| 3,932,727 | A | 1/1976 | True | |
| 5,064,089 | A | 11/1991 | Schultz | |
| 5,149,348 | A | 9/1992 | Bissinger | |
| 5,685,448 | A | 11/1997 | Thorwesten | |
| 5,775,357 | A * | 7/1998 | Regna et al. | 137/43 |
| 7,233,159 | B2 * | 6/2007 | Allgeyer | 324/750.08 |
| 2002/0164443 | A1 | 11/2002 | Oles et al. | |
| 2006/0152005 | A1 * | 7/2006 | Kertesz et al. | 285/406 |
| 2008/0050625 | A1 * | 2/2008 | Kaimann et al. | 429/22 |

* cited by examiner

DEVICE FOR EQUALIZING PRESSURE SURGES IN CLOSED SYSTEMS, SUCH AS SILOS OR THE LIKE

CROSS REFERENCE TO RELATED APPLICATIONS

This application is the National Stage of PCT/EP2007/010265 filed on Nov. 27, 2007, which claims priority under 35 U.S.C. §119 of German Application No. 20 2006 018 244.6 filed on Dec. 1, 2006. The international application under PCT article 21 (2) was not published in English.

The invention is directed at a device for equalizing pressure surges in the event of possible dust or gas explosions in closed systems, such as silos, pipelines, or the like, having a hinged lid that can pivot on an outlet connector or a case, which lid has a planar outer surface, whereby a deflecting plate for contact of the lid in the event of an explosion is provided on the outlet connector or case.

Such a device is known, for example, from WO95/10465. The hinged lid there, which opens in the event of an explosion, consists of metal sheets and is produced from aluminum, for example, in practice. In the event of an explosion, the hinged lid strikes against the deflecting plate, displacing the air that lies in between; the deflecting plate springs back, and the hinged lid is flung back into the closed position.

The known hinged lid already has a comparatively slight weight. Nevertheless, the technology propagated there can still be clearly improved, not only as far as the method of production and thus the production price are concerned, but also as far as the reduction in inertial mass is concerned, so that the goal of the invention, aside from efficient production, is, in particular, a clear weight reduction in the hinged lid, rapid replacement of the hinged lid in the event of damage, i.e. rapid first installation, and an improvement in the protective effect of the system.

This goal is achieved with a device of the type indicated initially, according to the invention, in that the hinged lid is formed from a carbon/glass fiber material.

Such materials are fundamentally known, but up to the present, they have not been used in the industrial sector in this manner.

Since the carbon/glass fiber material according to the invention can be processed in comparatively simple manner, and in particular, the desired shapes and/or profilings of such hinged lids can also be produced from such a material, the invention provides, in one embodiment, that the main lid body is formed from carbon/glass fiber mats that form the outer walls, with an enclosed body made of plastic, such as foam material, for example, forming the lid contour.

Additional embodiments of the invention are evident from the other dependent claims. In this connection, it can be provided, for example, that the plastic body enclosed by the carbon/glass fiber mats is configured as a sphere segment. Of course, similar spatial shapes are also possible here, for example polygonal cone stumps, bodies having an elliptical or parabolic cross-section, or more of the like.

To reinforce the lid, it can be provided that a plurality of carbon fiber rovings is provided between the carbon/glass fiber mats that form the outer walls of the lid, to form a support structure, and/or that the length of the carbon fiber rovings increases from the outer edge of the lid towards the lid interior.

Another method of construction of the lid can consist in forming at least a part of the enclosed foam material body from layers of carbon/glass fiber mats disposed on top of one another, whereby the glass fiber mats have a diameter that decreases per layer, towards the interior of the outlet connector or the case, in order to form a progression of the lid in an essentially hemispherical shape. Here again, carbon fiber rovings can be used, if necessary, which then pass through aligned bores in the mats, particularly if an alternation between glass fiber mats and foam material disks laid between them is provided.

Independent of its structure, it can also be provided, according to the invention, that a heat tape is laminated into a multi-layer carbon/glass fiber mat that faces out. The heat tape is particularly supposed to serve to prevent the lid from freezing up, if temperatures below the freezing point prevail in the surroundings of the lid.

According to the invention, it can also be provided that the carbon/glass fiber lid is configured essentially in circular shape, whereby the circular main lid body is positioned in a pivoting frame composed of carbon and glass fiber mats, whereby a foam material ring can be positioned between main lid body and pivoting frame, in one embodiment.

In order to guarantee that rainwater will bead off, the invention also provides, in another embodiment, that at least the lid surface is provided with a lotus effect coating.

Aside from the particularly light construction of the lid, the device according to the invention is also characterized in that a flame barrier body provided with a plurality of passage bores and/or structured as a honeycomb is positioned in the outlet connector, i.e. in the case, below the lid.

Aside from providing a honeycomb-structured flame barrier body, for example, within the outlet connector, it can also be provided, alternatively or additionally, according to the invention, that a flame barrier cage is positioned around the case and lid, whereby the flame barrier cage is formed from a support framework covered by a woven flame barrier fabric.

Fundamentally, it is known to provide such cases or outlet connectors having lids with an installation ring flange on the lower edge side, which flange has a plurality of bores by means of which the corresponding flange screw connections are then positioned. As an alternative to this, the invention provides that the outlet connector that carries the lid is provided with a bandage closure for quick installation.

A particularly advantageous embodiment of such a bandage closure consists in that this bandage closure is formed from at least one steel strip having at least one quick closure, whereby a plurality of clamping claws, having an approximately U shape in cross-section, particularly composed of a plastic material that can withstand great stress, is positioned on the steel strip, spaced apart from one another.

In order to particularly simplify transport of the device, it is also provided, according to the invention, that the spring-loaded deflection plate is held in the transport position by means of safety wires that are stepped in length, whereby safeguarding of the transport position of the spring-loaded deflection plate with stepped safety wires is seen in that when the safety wires are cut, the deflection plate first travels along a certain path, and is then held again on the next step of the safety wire. Once this wire is cut, another pivoting occurs, again followed by safeguarding with another step, and finally, complete cutting takes place, if applicable, in order to allow the deflection plate to pivot into its working position, thereby preventing the deflection plate from pivoting open over its entire angle range if a transport safeguard device is accidentally cut open, which can lead not only to destruction of objects in the immediate vicinity, but also to injuries to any persons who might be situated in the vicinity.

Additional characteristics, details, and advantages of the invention are evident from the following description and on the basis of the drawing. This shows, in FIG. 1 an exploded representation of the device according to the invention, FIG. 2 a partial view, in an exploded representation, of the device lid, FIG. 3 a top view of the lid with the glass fiber roving structure indicated, FIG. 4 a section through the lid, approximately along the line IV-IV in FIG. 3, FIG. 5*a* a fundamental representation of the layer structure of an embodiment of the lid, FIG. 5*b* a fundamental representation of the layer structure of a different embodiment of the lid, FIG. 6 a side view of the device, with the carbon fiber roving in the lid and the passage structure of a flame barrier body in the outlet connector, FIG. 7 a partial cross-section of the transition region from the case to a pipe connector, FIG. 8 a clamping ring having clamping claws, FIG. 9 a section through the clamping ring having a clamping claw, approximately along the line IX-IX in FIG. 8, FIG. 10 a part of the device according to the invention, with the deflection plate in the transport position, and the deflection plate after a stepped safeguard device has been opened, as well as in FIG. 11 the device according to the invention in a flame barrier cage.

The device indicated in general with 1, shown in an exploded representation in FIG. 1, has a case 2 or an outlet connector, which is closed off by means of a lid indicated in general with 3, whereby the lid is attached to the case 2 by way of corresponding rotating fittings 4 on flanges 5.

A pair of pivot pins 6 is also attached to the flanges 5, which springs act on hinge brackets 7 that carry a deflection plate 8, against which the device lid 3 can strike in the event of an explosion, so that it is braked by the air displacement connected with this.

As is also evident from FIG. 1, the case 2 can be attached to a connector 9, which is connected with a silo, for example, using clamping strips 10 that are equipped with a clamping closure 11.

Figure 2:
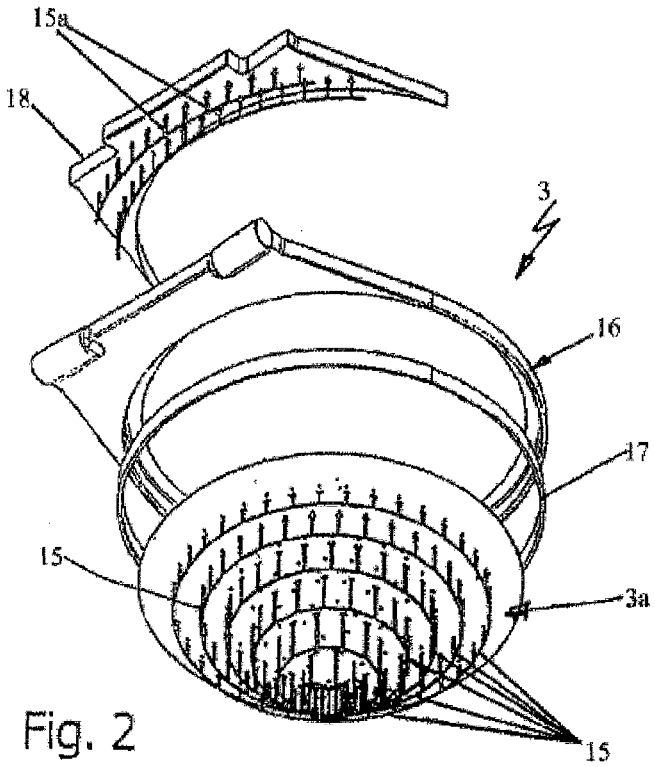
Figure 3:
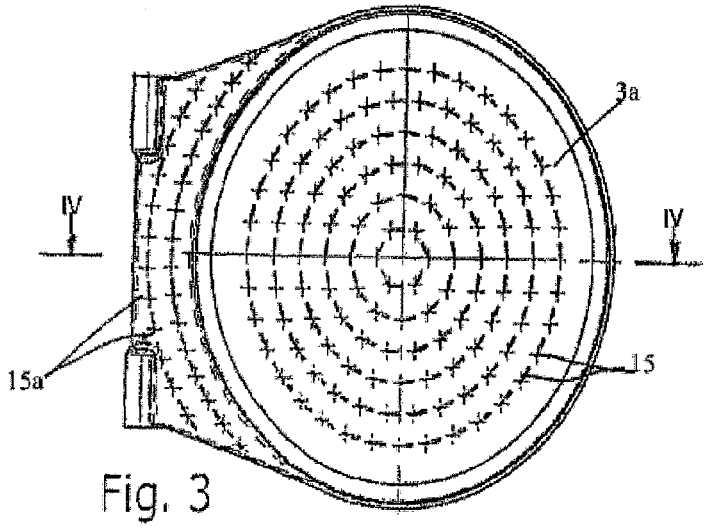

The hinged lid 3 is reproduced in an exploded representation in FIG. 2, in terms of its essential structure. The circular main lid body, indicated with 3*a* in FIG. 2, has a planar surface layer 12, which faces upward in the position of use, composed of a composite of carbon fiber mats and glass fiber mats, as will be described in greater detail below, in connection with FIG. 5.

Figure 4:
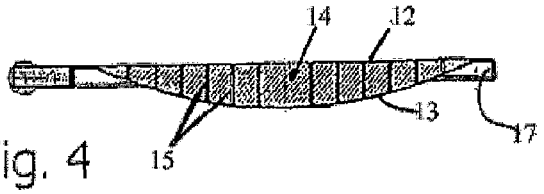

The surface 13 of the lid, which faces into the interior of the case 2, is also formed from a composite material, whereby a foam material body 14 is positioned between the two outer layers 12 and 13, specifically in the shape of a spherical segment as essentially shown in FIG. 4 in cross-section.

To connect the outer surface 12 with the inner surface 13, a plurality of carbon fiber rovings 15 is provided, which pass through corresponding recesses in the foam material body 11, and have a firm connection between the outer surface 12 and the inner surface 13, to stabilize the light construction lid 2.

The main lid body 3*a* is also formed from carbon fibers and glass fibers, in a pivot frame 16, whereby a foam body 18 and corresponding carbon fiber rovings 15*a* are also provided in the pivot frame.

As is evident from FIG. 4, a foam material ring 17 is positioned in an edge fold-back of the lid, in such a manner that it can lay itself over the top edge of the case 2, forming a seal, in the closure position.

Figure 5A:
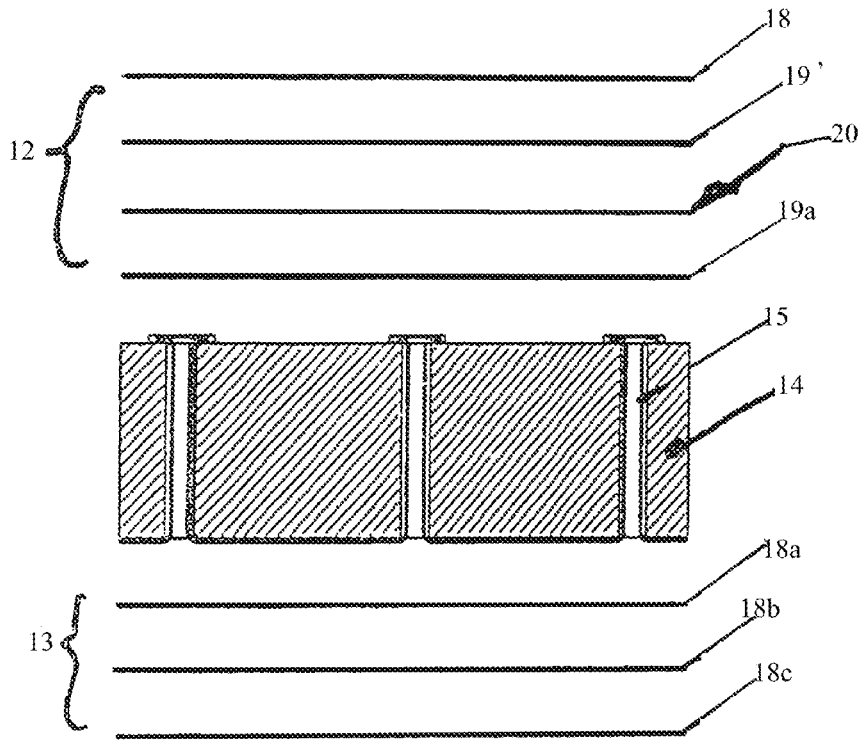

As is shown in FIG. 5*a*, in one exemplary embodiment, the lid structure consists first of an outer surface layer 12, this in turn of a carbon fiber layer 18, followed by a glass fiber layer 19, and, in the example shown, in turn followed by a heat tape 20 structured in the manner of a foil, followed by another glass fiber layer 19*a*. The foam material body 14, as already described, has carbon fiber rovings 15 passing through it, which are directly connected with the glass fiber layer 19*a* that lies on them.

The layer 13, which faces inward and follows the domed contour of the foam material body 14, is formed by three carbon fiber layers 18*a* to 18*c*, in the example shown, which are laminated onto one another, whereby the carbon fiber layer 18*a* that faces inward is also firmly connected with the carbon fiber rovings 15.

Figure 5B:
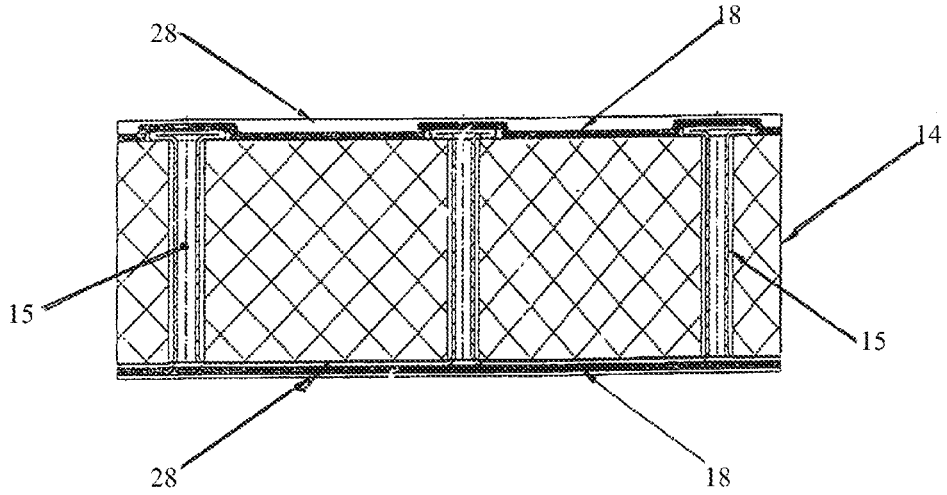

FIG. 5*b* shows a modified exemplary embodiment of the lid construction, whereby here, the carbon fiber rovings 15 as well as the outer and inner carbon fiber layer 18 are laminated on with a synthetic resin, i.e. cast in, surrounded by this resin. These regions are indicated with 28 in FIG. 5*b*.

Figure 6:
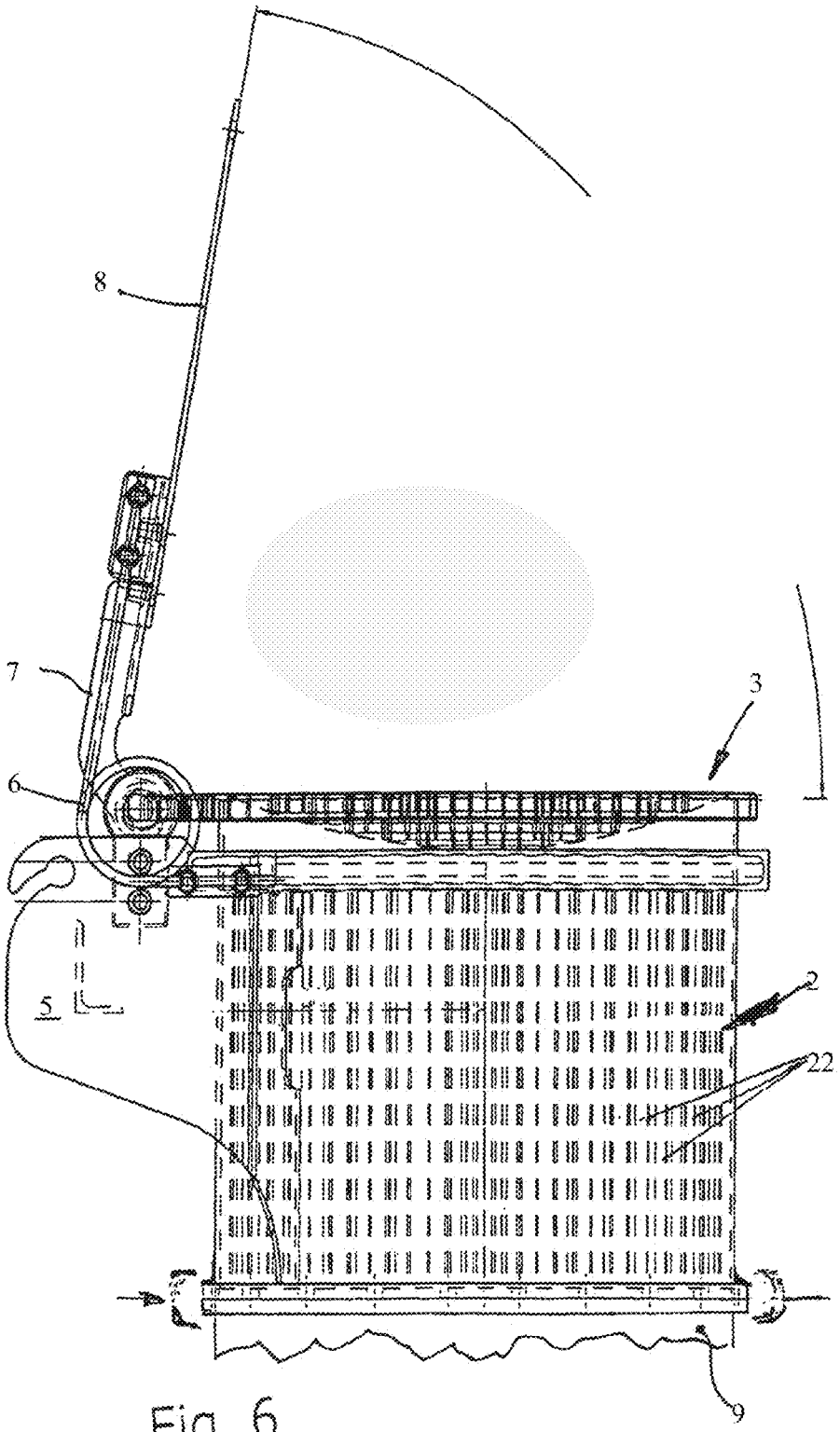

As is evident from FIG. 1 in combination with FIG. 6, for example, a flame barrier body 21 can be situated in the interior of the case 2, which body can have a honeycomb-shaped structure, as is also evident from FIG. 1.

In this connection, the honeycomb-shaped structure forms gas passage channels 22, as indicated in FIG. 6, with which channels the result is achieved that in the event of an explosion, a flame will not break through, since it will already have gone out as it passes through the channels 22, when the outside surface of the case 2 is reached.

Figure 7:
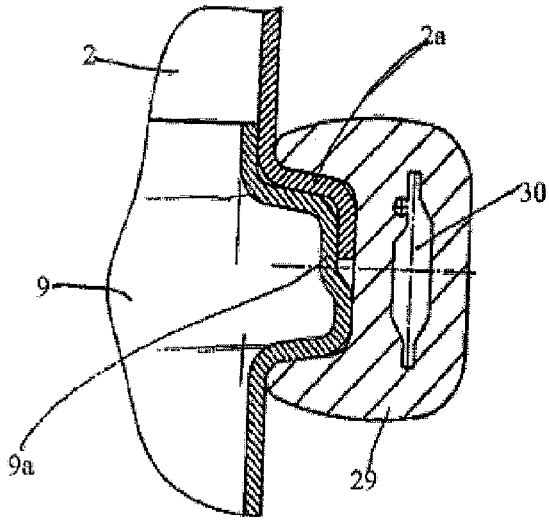
Figure 8:
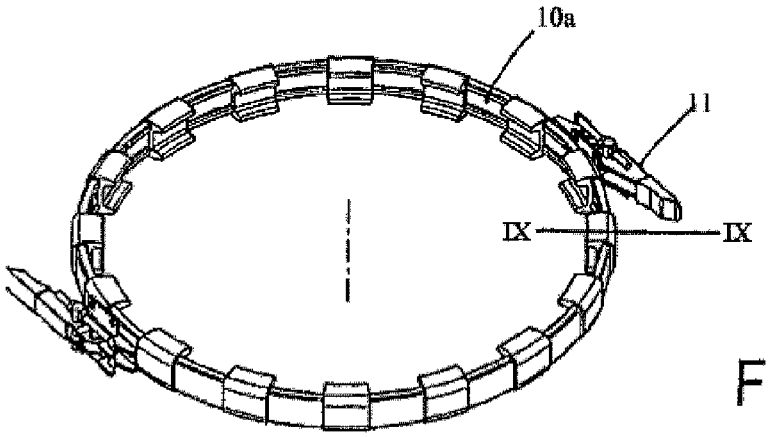
Figure 9:
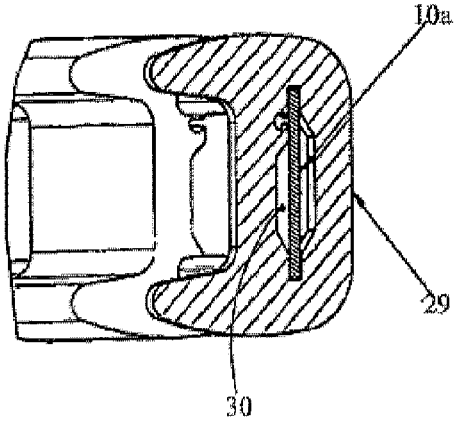

FIG. 7 to 9 show details of a clamping ring 10*a* having quick closures 11*a*, in a modification of the embodiment according to FIG. 1. Here, the case 2 is provided with a widened region that is approximately S-shaped in cross-section, in its lower outer edge region, as is particularly evident from FIG. 7. FIG. 7 also shows that the connector 9 has an edge bead 9*a* that is approximately U-shaped in cross-section and embossed toward the outside, which bead is correspondingly shaped and configured to interlock with the edge 2*a*.

This outside bead, which results in this manner, can be covered by clamping strips that are U-shaped in cross-section, as is evident from FIG. 1, or can be enclosed by a clamping strip 10*a*, onto which a plurality of clamping claws is threaded. These clamping claws 29 have an inner recess 30 through which steel strip 10*a* passes, as is evident from FIG. 9. These clamping claws 29 are able to withstand great stress and are pressure-resistant, because they are threaded onto the steel clamping strip 10*a*. Thus the overall construction is extremely light, but it nevertheless satisfies the requirements for securing the case 2 on a connector 9 or a pipe piece having a corresponding configured, upper edge bead 9*a* that faces outward.

Figure 10:
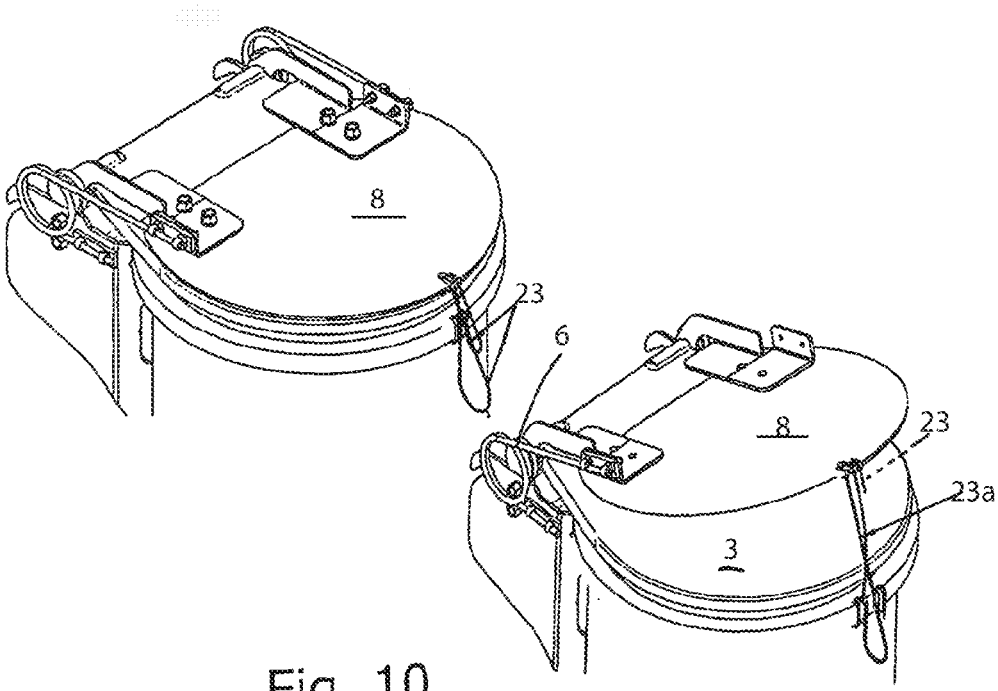

FIG. 10 shows how the deflection plate 8 is braced against the surface of the lid 3 in the transport position, specifically using multiple safety wires 23 in stepped lengths. Once the device 1 has been installed and is supposed to be brought into its functional position, the safety wires 23 can be opened, one after the other, from the shortest loop to the longest loop. In this connection, the deflection plate 8, which is under the tension of the spring 6, pivots upward into the corresponding steps, step-by-step, until the desired open position is reached.

Figure 11:
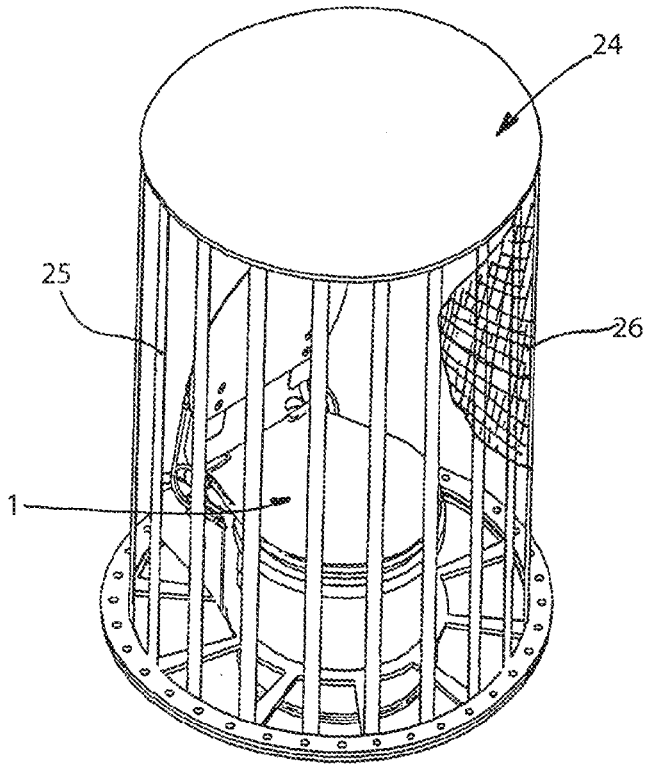

If a flame barrier body 21 within the case 2 is not desired, or if additional protection is supposed to be achieved, the device 1 as a whole can also be provided, as shown in FIG. 11, with a flame barrier cage indicated in general with 24, whereby there, a woven flame barrier fabric 26 is drawn over a support framework 25, preventing flames from passing through to the outside.

Of course, the exemplary embodiment of the invention as described can still be modified in many different ways, without departing from the fundamental idea. For example, the wires that prevent unintentional pivoting open of the deflection plate can be replaced with perforated strips, and more of the like.

The invention claimed is:

1. A device for equalizing pressure surges in the event of possible dust or gas explosions in closed systems, including silos and pipelines, comprising:

a hinged lid having a body and a planar surface that can pivot;

an outlet connector;

a deflecting plate for contact of the lid in the event of an explosion on the outlet connector, wherein the hinged lid is formed from a carbon/glass fiber material, whereby the lid body is formed from carbon/glass fiber mats that form outer walls, with an enclosed body made of plastic foam material, forming the lid contour;

wherein a heat tape is laminated into a side of the layer of carbon/glass fiber mat that faces outward and wherein said heat tape is configured to serve to prevent said hinged lid from freezing if temperatures fall below a freezing point; and wherein said deflecting plate is spring loaded and held in a transport position by means of multiple safety wires that are stepped in length.

2. The device according to claim 1, wherein the enclosed plastic body is configured approximately as a sphere segment.

3. The device according to claim 1, wherein a plurality of carbon fiber rovings is provided between the carbon/glass fiber mats that form outer walls of lid, to form a support structure.

4. The device according to claim 3, wherein the rovings are positioned in the plastic body and pass through the plastic body, whereby the rovings are cast in with synthetic resin.

5. The device according to claim 1, wherein the carbon/glass fiber mats are provided with aligned bores in a position of use, through which carbon fiber rovings pass.

6. The device according to claim 1, wherein the carbon/glass fiber lid is configured essentially in a circular shape, whereby the lid is positioned in a pivot frame composed of carbon and glass fiber mats, wherein a foam material ring and/or a reinforcement ring, as a rectangular plastic hollow profile, is positioned between the main lid body and the pivot frame.

7. The device according to claim 1, wherein at least the lid surface is provided with a coating.

8. The device according to claim 1, wherein a flame barrier body provided with a plurality of passage bores and structured as a honeycomb is positioned in the outlet connector.

9. The device according to claim 1, wherein a flame barrier cage is positioned around a case having a lid, and wherein the flame barrier cage is formed from a support framework covered by a woven flame barrier fabric.

10. The device according to claim 1, wherein the outlet connector, in a form of a case that carries the lid has a pressure-resistant bandage closure for quick installation.

11. The device according to claim 10, wherein the bandage closure is formed from at least one steel strip having at least one quick closure, whereby a plurality of clamping claws, having an approximately U shape in cross-section, particularly composed of a plastic material that can withstand great stress, is positioned on the steel strip, spaced apart from one another.

* * * * *

UNITED STATES PATENT AND TRADEMARK OFFICE

CERTIFICATE OF CORRECTION

PATENT NO. : 8,720,483 B2
APPLICATION NO. : 12/312618
DATED : May 13, 2014
INVENTOR(S) : Thorwesten It is certified that error appears in the above-identified patent and that said Letters Patent is hereby corrected as shown below:

In the Claims

In Column 5, line 33 (line 3 of Claim 3) before the word "lid" please insert: -- the --.

Signed and Sealed this
Fifth Day of August, 2014

Michelle K. Lee

Michelle K. Lee
*Deputy Director of the United States Patent and Trademark Office*